US006977635B2

(12) United States Patent
Ogawa et al.

(10) Patent No.: US 6,977,635 B2
(45) Date of Patent: Dec. 20, 2005

(54) IMAGE DISPLAY DEVICE

(75) Inventors: Yoshinori Ogawa, Yamatotakada (JP); Masafumi Katsutani, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 311 days.

(21) Appl. No.: 10/092,255

(22) Filed: Mar. 7, 2002

(65) Prior Publication Data

US 2003/0006997 A1 Jan. 9, 2003

(30) Foreign Application Priority Data

Jul. 6, 2001 (JP) ..... 2001-206956

(51) Int. Cl.[7] ..... G09G 3/36

(52) U.S. Cl. ..... 345/93; 345/96; 345/98; 345/103

(58) Field of Search ..... 345/50, 55, 93–94, 345/95–96, 98–100, 103, 89–92, 204, 619, 345/634, 640, 677, 690–692, 90

(56) References Cited

U.S. PATENT DOCUMENTS

| | | | | |
|---|---|---|---|---|
| 5,926,158 A | * | 7/1999 | Yoneda et al. | 345/90 |
| 6,130,654 A | * | 10/2000 | Hayashi et al. | 345/63 |
| 2002/0050972 A1 | * | 5/2002 | Udo et al. | 345/96 |

FOREIGN PATENT DOCUMENTS

| | | | |
|---|---|---|---|
| JP | 9-212137 | | 8/1997 |
| JP | 09-212137 | * | 8/1997 |
| JP | 10-123483 | | 5/1998 |
| JP | 10-326090 | * | 12/1998 |
| JP | 11-95729 A | | 4/1999 |
| JP | 2001-56665 A | | 2/2001 |

* cited by examiner

*Primary Examiner*—Vijay Shankar
*Assistant Examiner*—Leonid Shapiro
(74) *Attorney, Agent, or Firm*—Birch, Stewart, Kolasch & Birch, LLP.

(57) ABSTRACT

A line inverse driving method is performed by outputting voltages for gradation display in mutually reverse polarities with respect to pixels adjacent in a data signal line direction. A separation switch is provided between an output stage of a data driver and a data signal line to separate them. In a blanking period, the data signal line is cut off, and in the selection-scanning period of a scanning signal line to be scanned first, the scanning signal line to be scanned next is also subjected to the selection-scanning. With this structure, respective charges in adjacent pixel capacitors are neutralized, and it is therefore possible to reduce a power consumption. Further, since a short-circuit can be performed at short distance, the problem of dull waveform can be suppressed, thereby realizing an image display device suited for a large screen.

11 Claims, 12 Drawing Sheets

DATA SIGNAL LINE

| SCANNING SIGNAL LINE | 1 | 2 | 3 | 4 | 5 | 6 |
|---|---|---|---|---|---|---|
| 1 | + | − | + | − | + | − |
| 2 | − | + | − | + | − | + |
| 3 | + | − | + | − | + | − |
| 4 | − | + | − | + | − | + |
| 5 | + | − | + | − | + | − |
| 6 | − | + | − | + | − | + |
| 7 | + | − | + | − | + | − |
| 8 | − | + | − | + | − | + |

DATA SIGNAL LINE

| SCANNING SIGNAL LINE | 1 | 2 | 3 | 4 | 5 | 6 |
|---|---|---|---|---|---|---|
| 1 | − | + | − | + | − | + |
| 2 | + | − | + | − | + | − |
| 3 | − | + | − | + | − | + |
| 4 | + | − | + | − | + | − |
| 5 | − | + | − | + | − | + |
| 6 | + | − | + | − | + | − |
| 7 | − | + | − | + | − | + |
| 8 | + | − | + | − | + | − |

IMAGE DISPLAY DEVICE

FIELD OF THE INVENTION

The present invention relates to an image display device of the active matrix type including an electro-optical element, and a switching element and a pixel capacitor corresponding to the switching element provided in each pixel region surrounded by respective adjacent two lines of a plurality of scanning signal lines and a plurality of data signal lines which cross each other.

BACKGROUND OF THE INVENTION

For liquid crystal display devices or other similar devices, the AC driving is conventionally adopted to suppress deteriorations of liquid crystal elements (electro-optical elements). In the AC driving, however, when reversing polarities of voltages for gradation display, it is required for a data signal line driving circuit to charge them to a voltage for gradation display as desired after discharging a data signal line and a pixel capacitor by inputting charges in reverse polarity, which results in large amount of power consumption. As a typical conventional technique to counteract this problem, for example, Japanese Unexamined Patent Publication No. 9-212137 (Tokukaihei 9-212137, published on Aug. 15, 1997) discloses the following driving method.

FIG. 12 is a block diagram which schematically illustrates the structure of Japanese Unexamined Patent Publication No. 9-212137. In this conventional technique, the frame inverse driving method is adopted wherein voltages for gradation display in mutually reverse polarities are output between adjacent frames. Further, to suppress an occurrence of flicker, the line inverse driving method wherein voltages for gradation display in mutually reverse polarities are applied between pixels adjacent in the data signal line direction, and the dot inverse driving method wherein voltages for gradation display in mutually reverse polarities are applied between adjacent pixels in the scanning signal line direction are also adopted in combination with the above-mentioned frame inverse driving method.

In the foregoing driving method, the polarity of the display data is switched at every frame, for example, between the frame of FIG. 13(*a*) and the frame of FIG. 13(*b*). FIG. 13(*a*) and FIG. 13(*b*) respectively show portions corresponding to 8×6 pixels of a liquid crystal panel. When comparing FIG. 13(*a*) and FIG. 13(*b*), it can be seen that the polarities of all the pixels are switched at every frame, and in each frame, polarities of adjacent pixels in the data signal line direction (up-and-down direction in FIG. 13(*a*) and FIG. 13(*b*)) are switched, which indicates that the line inverse driving method is performed. Further, polarities of adjacent pixels in the scanning signal line direction (left-to-right direction in FIG. 13(*a*) and FIG. 13(*b*)) are switched, which indicates that the dot inverse driving method is performed.

As illustrated in FIG. 12, separation switches s1, s2, . . . , sn are provided in data signal lines d1, d2, . . . , dn connected to a data driver 1 respectively, and further, between adjacent data signal lines d1, d2, . . . , n, short switches sw1, sw2, . . . , swn-1 are provided for short circuiting the data signal lines at downstream sides of the separation switches s1 to sn. When scanning respective scanning signal lines in order, and applying voltages for gradation display for data signal lines d1 to dn to pixel capacitors via respective switching elements of the pixels, the separation switches s1 to sn conduct, and the short switches sw1 to swn-1 are cut off.

On the other hand, directly before a voltage for gradation display is applied to each pixel, a blanking period is set where separation switches s1 to sn are cut off, and short-circuit switches sw1 to swn-1 conduct. As a result, the pixel capacitors in pixels on a line to be subjected to the selection scanning are short-circuited by short-circuit switches sw1 to swn-1 via data signal lines d1 to dn from respective switching elements of the pixels, and positive charges and negative charges which exist substantially evenly are neutralized to be the same potential. Here, the cut-off of the switches s1 to sn does not adversely affect the short-circuiting of the output stage of the data driver 1.

According to the foregoing driving method, the data driver 1 is only required to charge the respective pixel capacitors to voltages for gradation display reversed from the neutralized, and it is therefore possible to suppress the power consumption of the data driver 1.

In general, in the liquid crystal panel, the number of data signal lines is twice as large as the number of the scanning signal lines. For example, for a compact-size liquid crystal panel for portable phones, the number of data signal lines is 168, while the number of scanning signal lines is 80. This is because, lines corresponding to R, G, B display data outputs for color display are provided for the data signal lines. In the foregoing conventional techniques, it is required to provide a large number of output terminals in the data driver 1, and also to provide short-circuit switches sw1 to s2n in the data driver 1 besides the separation switches s1 to sn, which results in another problem of increasing an area of an IC chip for the data driver 1. Moreover, the further is positioned the data signal line in selection-scanning order from the top, i.e., from the data driver 1, the longer is the distance between the data signal line d1 to dn and short-circuit switch sw1 to swn-1. Therefore, it is more likely that charges cannot be neutralized completely due to a drop in voltage caused by a large wiring resistance, and the power consumption cannot be reduced significantly. Further, as the lines becomes longer, a response time becomes longer due to dull waveform. Therefore, the effect of suppressing the power consumption would be small for a large screen display device in which long data signal lines are provided.

SUMMARY OF THE INVENTION

It is therefore an object of the present invention to realize an image display device suited for a large-size screen with a data signal line driving circuit of a simple structure.

In order to realize the above object, an image display device of the present invention is characterized by including:

a plurality of scanning signal lines and a plurality of data signal lines which cross each other;

an electro-optical element, and a switching element and a pixel capacitor which correspond to the electro-optical element, the electro-optical element and corresponding switching element and pixel capacitor being provided in each pixel region surrounded by adjacent two of the plurality of scanning signal lines and adjacent two of the plurality of data signal lines;

a data signal line driving circuit for outputting voltages for gradation display in mutually reverse polarities with respect to a pair of adjacent pixels; and short-circuit means for short-circuiting respective pixel capacitors of the pair of adjacent pixels in a non-selection period directly before a selection-scanning period of a target scanning signal line when scanning by switching polarities of the voltages for gradation display.

According to the foregoing structure, the data signal line driving circuit output voltages for gradation display in mutually reverse polarities with respect to a pair of adjacent pixels. Namely, when AC driving, the line inverse driving method wherein voltages for gradation display in reverse polarities are output with respect to adjacent pixels in the data signal line direction, and/or the dot inverse driving method wherein voltages for gradation display in reverse polarities are output with respect to adjacent pixels in the scanning signal line direction are/is adopted. Further, the frame inverse driving method wherein voltages for gradation display in reverse polarities are output with respect to adjacent frames may also be adopted in the above AC driving.

Then, when switching polarities of voltages for gradation display at every one or every plurality of frames, the short-circuit means short-circuits the pair of pixel capacitors in the selection scanning period of the previous scanning signal line, i.e., in the non-selection period directly before the selection-scanning period of the target scanning signal line.

Therefore, when switching polarities of voltages for gradation display, after neutralizing respective charges in pixel capacitors of adjacent pixels in reverse polarities, the target scanning signal lines are subjected to selection-scanning, and then the data signal is input. As a result, it is possible to reduce an amount of charges required for the data signal line driving circuit to charge the data signal line and to reduce power consumption. Further, the neutralization of charges is performed between adjacent pixels, and the short-circuit means is provided on the display panel. It is therefore possible to realize the data signal line driving circuit of simplified structure, and to suppress the problem of dull waveform. Furthermore, the pixels are short-circuited in the non-selection state, and the pixels are separated from the data signal lines, and thus adverse effects on the data signal line driving circuit can be avoided, thereby realizing the structure suited for a large-size screen.

It is preferable that the foregoing image display device be arranged so as to include:

a positive voltage output section for outputting a positive voltage converted from a data signal;

a negative voltage output section for outputting a negative voltage converted from a data signal; and a switching section for switching the positive output section and the negative output section between adjacent data signal lines, wherein the positive voltage output section and the negative voltage output section are used in common in the adjacent data signal lines.

In the foregoing structure, the positive voltage output section may be composed of a positive polarity D/A converter and an operational amplifier of an N-channel MOS transistor input, and the negative voltage output section may be composed of a negative polarity D/A converter and an operational amplifier of a P-channel MOS transistor input.

According to the foregoing structure, it is possible to reduce the required structure to about the half as that required in the case of adopting the D/A conversion circuits and operational amplifiers in both positive and negative polarities for each data signal line, thereby realizing reduction in chip-size and the power consumption.

In order to realize the above object, another image display device of the present invention is characterized by including:

a plurality of scanning signal lines and a plurality of data signal lines which cross each other;

an electro-optical element, and a switching element and a pixel capacitor which correspond to the electro-optical element, the electro-optical element and corresponding switching element and pixel capacitor being provided in each pixel region surrounded by adjacent two of the plurality of scanning signal lines and adjacent two of the data signal lines;

a data signal line driving circuit for outputting voltages for gradation display in mutually reverse polarities with respect to a pair of adjacent pixels; and separation means for separating an output stage of the data signal line driving circuit from a data signal line in a first half of a selection-scanning period of each scanning signal line by a scanning signal line driving circuit, the separation means being provided between the output stage of the data signal line driving circuit and the data signal line, wherein the data signal line driving circuit outputs voltages for gradation display in mutually reverse polarities with respect to adjacent pixels in a direction of the data signal line; and the scanning signal line driving circuit carries out a selection-scanning operation by switching polarities of voltages for gradation display, with respect to both of a data signal line to be scanned first and a data signal line to be scanned next of a pair, in a first half of the selection-scanning period of the scanning signal line to be scanned first of the pair.

In order to realize the above object, a still another image display device of the present invention is characterized by including:

a plurality of scanning signal lines and a plurality of data signal lines which cross each other;

an electro-optical element, and a switching element and a pixel capacitor which correspond to the electro-optical element, the electro-optical element and corresponding switching element and pixel capacitor being provided in each pixel region surrounded by adjacent two of the plurality of scanning signal lines and adjacent two of the data signal lines;

a data signal line driving circuit for outputting voltages for gradation display in mutually reverse polarities with respect to a pair of adjacent pixels; and separation means for separating an output stage of the data signal line driving circuit from the data signal line in a blanking period directly before a selection-scanning period of each scanning signal line by a scanning signal line driving circuit, the separation means being provided between the output stage of the data signal line driving circuit and the data signal line, wherein the data signal line driving circuit outputs voltages for gradation display in mutually reverse polarities with respect to adjacent pixels in a direction of the data signal line; and the scanning signal line driving circ uit carries out a selection-scanning operation by switching polarities of voltages for gradation display, with respect to both of a data signal line to be scanned first and a data signal line to be scanned next in a pair, in the blanking period directly before the selection-scanning period of the scanning signal line to be scanned first of the pair.

According to the foregoing structure, the data signal line driving circuit output voltages for gradation display in mutually reverse polarities with respect to a pair of adjacent pixels. Namely, when AC driving, the line inverse driving method wherein voltages for gradation display in reverse polarities are output with respect to adjacent pixels in the data signal line direction, and/or the dot inverse driving method wherein voltages for gradation display in reverse polarities are output with respect to adjacent pixels in the scanning signal line direction and/is adopted. Further, the frame inverse driving method wherein voltages for gradation display in reverse polarities are output with respect to adjacent frames may also be adopted in the above AC driving.

When switching polarities of voltages for gradation display at every frame or every plurality of frames, the scanning signal line driving circuit carries out a selection-scanning operation by switching polarities of voltages for gradation display with respect to both of the data signal line to be scanned first and the data signal line to be scanned next in the pair, in the blanking period directly before the selection-scanning period of the scanning signal line to be scanned first of the pair. Here, the data signal line is separated from the data signal line driving circuit by the separation means.

Therefore, in the adjacent pixels of the pair, by carrying out selection/scanning of the scanning signal lines simultaneously in the blanking period directly before the selection-scanning period of the scanning signal line to be scanned first, only this scanning signal line is subjected to selection scanning after neutralizing the charges of the pixel capacitors via the data signal line, and the data signal line is input into the pixel capacitor from the data signal line driving circuit. Then, in the blanking period directly before the selection-scanning period of the scanning signal line to be scanned next, both of the scanning signal lines in the pair are set in the non-selection state, and then only the scanning signal line to be scanned next is subjected to selection scanning, and the data signal is input into the pixel capacitor from the data signal line driving circuit.

Therefore, when switching polarities of voltages for gradation display, the charges in pixel capacitors between adjacent pixels in mutually reverse polarities can be sufficiently neutralized. It is therefore possible to reduce an amount of charges required for the data signal line driving circuit to charge the data signal line, thereby realizing a reduction in power consumption and suppressing the problem of dull waveform. As a result, the present invention is suited for a large-size screen. Furthermore, the foregoing neutralization of charges is performed by using the switching element for each pixel and the data signal line. Namely, according to the present invention, it is possible to neutralize the charges only by modifying the selection scanning of the scanning signal line driving circuit without requiring switches for short-circuiting.

It is preferable that the foregoing image display device be arranged so as to further include control means for controlling to cut off the separation means in a blanking period at every two horizontal scanning periods, the blanking period being provided directly before the selection-scanning period of the scanning signal line to be scanned first of the pair, and to perform the selection-scanning operation of the target pair of scanning signal lines in the cut-off state of the separation means.

The other objects, features, and superior points of this invention will be made clear by the description below. Further, the advantages of this invention will be evident from the following explanation which refers to the Figures.

BRIEF DESCRIPTION OF THE DRAWINGS

FIGS. 13(*a*) and FIG. 13(*b*) are explanatory views which explain AC driving.

DESCRIPTION OF THE EMBODIMENT

The following will explain one embodiment of the present invention in reference to FIG. 1 through FIG. 11.

Figure 1:
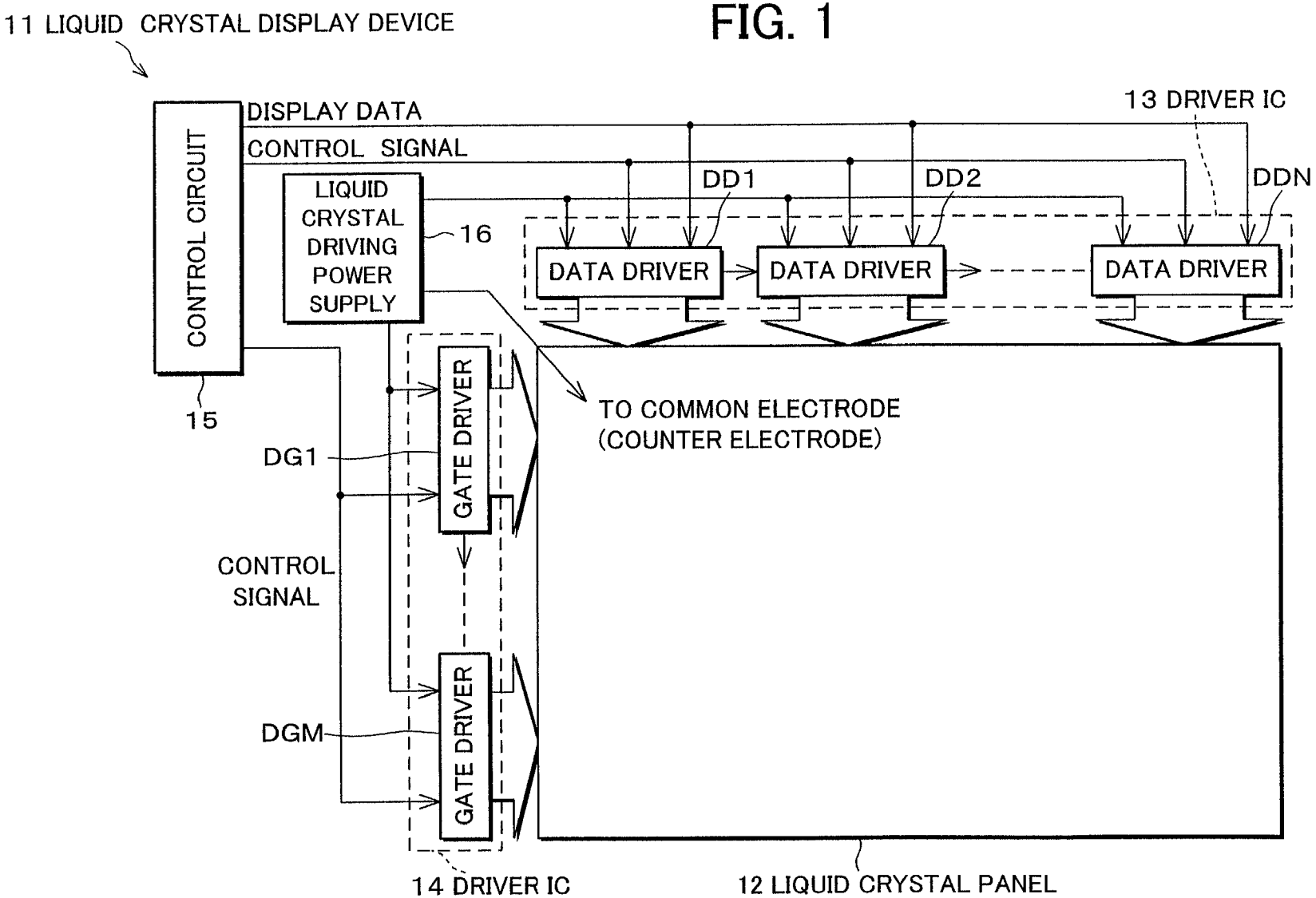
FIG. 1 is a block diagram illustrating an entire structure of a liquid crystal display device in accordance with one embodiment of the present invention.

FIG. 1 is a block diagram illustrating an entire structure of a liquid crystal display device 11 in accordance with one embodiment of the present invention. As illustrated in FIG. 1, the liquid crystal display device 11 includes a liquid crystal panel 12 of the TFT active matrix type, and a driver IC 13 provided on one side of the liquid crystal panel 12, and a driver IC 14 provided on the other side of the liquid crystal panel 12. These driver ICs 13 and 14 selectively apply voltages from a liquid crystal driving power supply 16 to the liquid crystal panel 12 in response to outputs from a control circuit 15, to perform display operations. The driver IC 13 is composed of data drivers N in number, i.e., DD1 to DDN (hereinafter simply referred to as DD when it is not necessarily be specified), and the driver ID 14 is composed of gate drivers M in number, i.e., DG1 to DGM (hereinafter simply referred to as DG when it is not necessarily be specified).

The control circuit 15 outputs to the driver IC 13 a horizontal synchronization signal, a start pulse and a clock signal as control signals, and outputs to the driver IC 14 a horizontal synchronization signal and a vertical synchronization signal as control signals. Further, display data are output from the control circuit 15 to the driver IC 13. In the present invention, to the control signals to be output from the control circuit 15 to the driver IC 13, a separation signal (to be described later) is added, and to the controls signals to be output from the control circuit 15 to the driver IC 14, a blanking signal (to be described later) is added. This blanking signal, however, may be generated in the driver IC 14 utilizing the horizontal synchronization signal.

Figure 2:
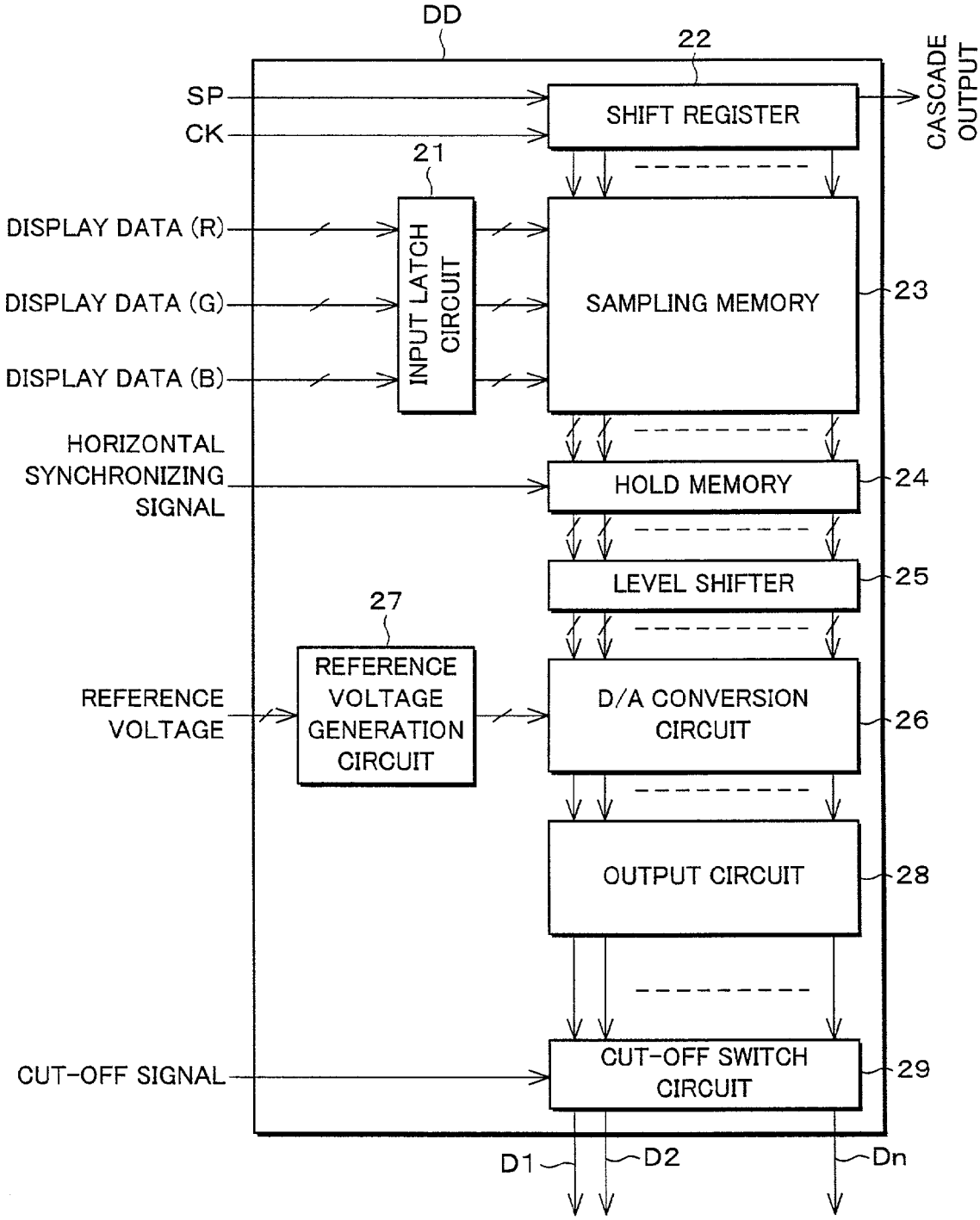
FIG. 2 is a block diagram illustrating one example structure of a data driver in accordance with a liquid crystal display device of FIG. 1.

FIG. 2 is a block diagram illustrating one example structure of the data driver DD. Digital display data R, G, B (6-bit each for 64 gradation display from the control circuit 15 are input to and latched in the input latch circuit 21. On the other hand, the start pulse SP is sequentially transferred in the shift register 22 in synchronization with a clock CK, and in response to a control signal to be output from each stage of the shift register 22, the digital display data to be output from the input latch circuit 21 is input by time-division in a sampling memory 23 to be temporarily stored therein. Then, when inputting the display data for one line in the sampling memory 23 at a timing of the horizontal synchronization signal, all the display data stored in the sampling memory 23 are stored in a hold memory 24 in a lump. These display data are kept latched until the next horizontal synchronization signal is input.

Then, the display data as latched are converted in the level shifter 25 to a maximum driving voltage level to be applied to the liquid crystal panel 12, and are then input to a D/A conversion circuit 26. In the D/A conversion circuit 26, one of voltage values corresponding to display data is selected from voltages for gradation display (64-level voltage values for 64 gradation display) to be applied to data signal lines D1 to Dn of the liquid crystal panel 12, as generated from a reference voltage generation circuit 27 based on a plurality of reference voltages to be output from the liquid crystal driving power supply 16, and is output via an output circuit 28. Here, the characteristic feature of the present invention lies in that a separation switch 29 (to be described later) is provided between the output circuit 28 and data signal lines D1 to Dn (hereinafter referred to as D (if it is not necessarily be specified)).

Figure 3:
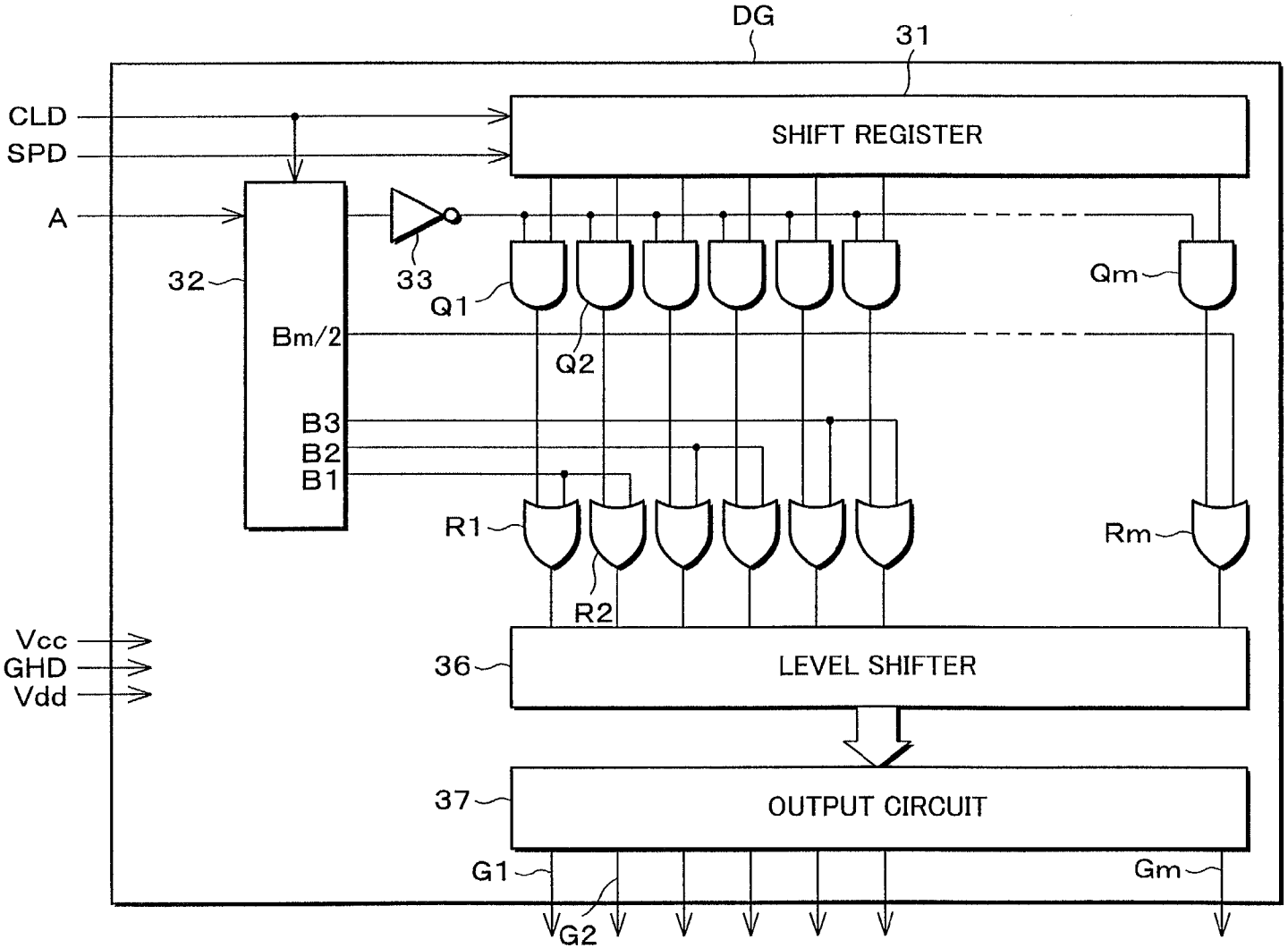
FIG. 3 is a block diagram illustrating one example structure of a gate driver in accordance with a liquid crystal display device of FIG. 1.
Figure 4:
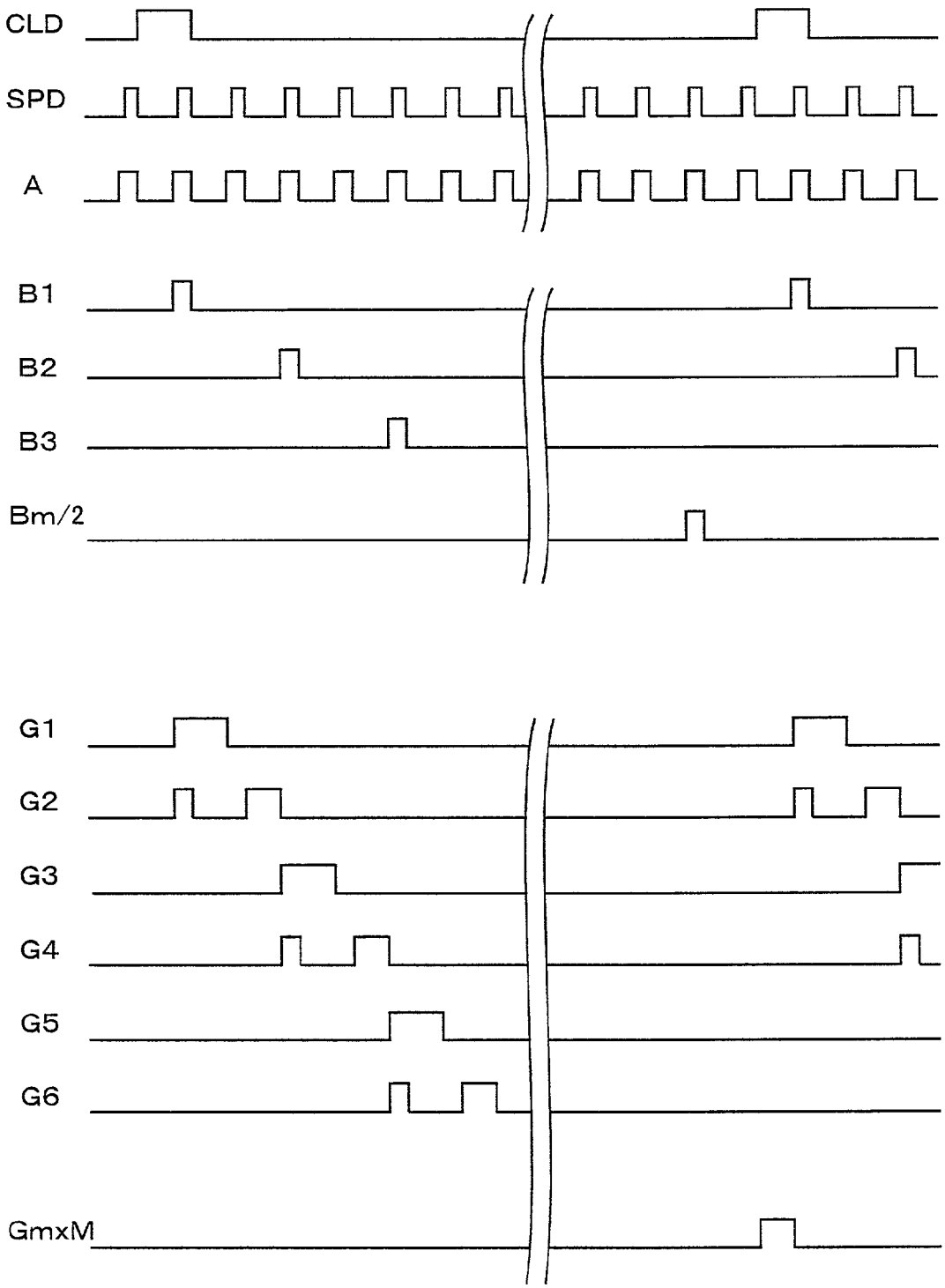
FIG. 4 is a timing chart of a gate driver of FIG. 3.

FIG. 3 is a block diagram illustrating one example structure of the gate driver DG of the present invention. FIG. 4 is a timing chart of the gate driver DG of FIG. 3. To this gate driver DG, the horizontal synchronization signal SPD, the vertical synchronization signal CLD and the blanking signal A are input from the control circuit 15. Then, the horizontal synchronization signal SPD, and the vertical synchronization signal CLD are input to the shift register 31 where the vertical synchronization signal CLD is transferred in order in synchronization with the horizontal synchronization signal SPD as a transfer clock. Then, the outputs from respective gates of the shift register 31 are input to the input terminals on one side of the AND gates Q1 to Qm, and the blanking signals A as input from the control circuit 15 are inverted in the timing adjustment circuit 32 and the inverter 33, to be input to the input terminals on the other side of the AND gates Q1 to Qm.

Figure 5:
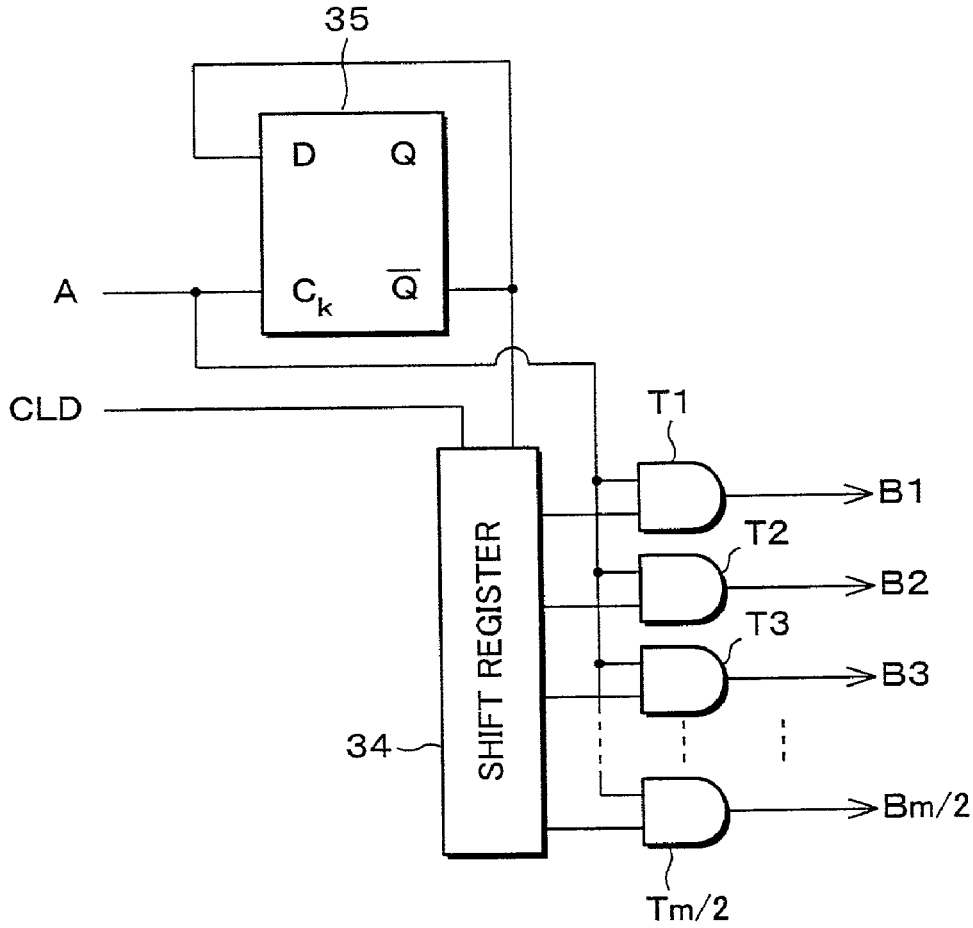
FIG. 5 is a block diagram illustrating one example structure of a timing adjusting circuit adopted in the gate driver of FIG. 3.

FIG. 5 is a block diagram illustrating one example structure of the timing adjustment circuit 32. This timing adjustment circuit 32 includes a shift register 34, a D flip-flop 35, and AND gates T1 to Tm/2. To the clock input terminal CK of the D flip-flop 35, the blanking signal A is input, and the inverse output /Q is fed back into the data input terminal D. Therefore, to this D flip-flop 35, the blanking signal A whose cycle is divided into half is input to the shift register 34.

Then, the shift register 34 transfers the vertical synchronization signal CLD based on the inverse output /Q of the D flip-flop 35 as a clock. Therefore, outputs from the shift register 34 are respectively applied to the input terminals on one side of the AND gates T1 to Tm/2 at every two periods of the blanking signal (≈ two horizontal periods) To the input terminals on the other side of the AND gates T1 to Tm/2, the blanking signal A is input, and thus the outputs B1 to Bm/2 from the AND gates T1 to Tm/2 are output in the blanking period at every two horizontal periods.

The outputs B1 to Bm/2 are then input to the input terminals on one side of respective pairs of adjacent OR gates of odd-numbered OR gates R1, R3, . . . , Rm-1 and even-numbered OR gates R2, R4, . . . , Rm. On the other hand, outputs from the AND gates Q1 to Qm are input to the input terminals on the other side of the OR gates R1 to Rm. Therefore, the odd-numbered scanning signal line, for example, the output from the OR gate R1 corresponding to G1 is set to a high level over the blanking period directly before the selection scanning of the scanning signal line G1 and the subsequent selection scanning period. Then, the outputs from an even-numbered scanning signal line, for example, the output from the OR gate R2 corresponding to G2 is once switched to a high level over the blanking period of the scanning signal line G1, and is then switched to a low level in the selection scanning period of the scanning signal line G1 and the blanking period of the scanning signal line G2, and is again switched to the high level in the selection scanning period of the scanning signal line G2.

As described, by making pairs of adjacent scanning signal lines of the odd-numbered scanning signal lines G1, G3, . . . , Gm-1 and the even-numbered scanning signal lines G2, G4, . . . , Gm, both lines in each pair are set to high level in the blanking period of each odd-numbered scanning signal line G1 to Gm-1 to be scanned first in each pair. Further, respective switching elements to be connected to each pair of the scanning signal lines G1 to Gm-1 and G2 to Gm conduct, and the pixel capacitors are short-circuited in the liquid crystal panel 12.

An output from each of the OR gates R1 to Rm is level shifted to the maximum liquid crystal driving voltage in the level shifter 36, and to each of the scanning signal lines G1 to Gm (hereinafter simply referred to as G) from the output circuit 37 as a buffer circuit. In FIG. 2, the data signal lines D are provided n in number, and thus the total number of the data signal lines D provided in the entire structure of the liquid crystal display device 11 of FIG. 1 is m×N. Similarly, in FIG. 3, the scanning signal lines G are provided m in number, and thus the total number of the scanning signal lines G provided in the entire structure of the liquid crystal display device 11 is m×M in number.

FIGS. 6 to 10 which explain operations of the present invention are block diagrams illustrating the structure of two output terminals from the output stage of the data driver DD to a part of the liquid crystal panel 12. These data drivers DD adopt the following three types of driving methods in combination, i.e., i) the dot inverse driving method for outputting voltages for gradation display in mutually reverse polarities between adjacent pixels in the direction of the scanning signal line G, ii) the line reverse driving for outputting voltages for gradation display in mutually reverse polarities between adjacent pixels in the direction of the data signal line D, and iii) the frame inverse driving method for outputting voltages for gradation display in mutually reverse polarities between adjacent frames.

Therefore, the output stage of the data driver DD is also arranged such that every adjacent two data signal lines of odd-numbered data signal lines D1, D3, . . . , and even-numbered data signal lines D2, D4, . . . make pairs. Then, the D/A conversion circuits DA1 and DA2 corresponding to the D/A conversion circuit 26 of FIG. 2 and the operational amplifiers OP1 and OP2 corresponding to the output circuit 28 are arranged such that the odd-numbered D/A conversion circuits DA1, DA3 . . . and the even-numbered D/A conversion circuits DA2, DA4, . . . are used respectively in pairs, and the odd-numbered operational amplifiers OP1, OP3, . . . and the even-numbered operational amplifiers OP2, OP4 . . . are used respectively in paris.

The odd-numbered D/A conversion circuits DA1, DA3, . . . and the operational amplifiers OP1, OP3, . . . output voltages in positive polarity, while the even-numbered D/A conversion circuits DA2, DA4, . . . , and the operational amplifiers OP2, OP4, . . . output voltages in negative polarities. For AC output, switches Sa1, Sa2, . . . , and switches Sb1, Sb2, . . . are provided for switching the above inputs and outputs. In FIGS. 6 to 10, the level shifter 25 is omitted.

The display data to be held in the hold memory M1, M2, . . . provided for each data signal line D is input via the switches Sa1, Sa3 which operate in response to a reverse polarity signal from the control circuit 15 (only DA1 and DA2 are shown in FIGS. 6 to 10). Gradation display voltages from the odd-numbered operational amplifiers OP1, OP3, . . . , and gradation display voltages from the even-numbered operational amplifiers OP2, OP4, . . . , are switched at even horizontal period and are output via the switch Sb1, Sb2, . . . , in response to a signal in reverse polarity (only OP1 and OP2 are shown in FIGS. 6 to 10).

According to the foregoing structure, outputs from the positive polarity D/A conversion circuits DA1, DA3, etc., are applied to the operational amplifiers OP1, OP3, . . . , each being composed of a voltage follower adopting an operational amplifier of the direct N-channel MOS transistor input. On the other hand, outputs from negative polarity D/A conversion circuits DA2, DA4, . . . , are applied to operational amplifiers OP2, OP4, etc., each being composed of a voltage follower adopting the operational amplifier of the direct P-channel MOS transistor input, while outputs from respective operational amplifiers OP1, OP3 are applied via switches Sb1, Sb2 . . . to output terminals as desired.

In general, as an essential function of the output terminal of the liquid crystal driving circuit, the full range of the power supply voltage is required for the output dynamic range. For example, in the case of adopting an MOS transistor of the enhancement type generally adopted in the LSI, which is cut off when the gate is at 0 V, in order to eliminate an inoperable region due to the threshold voltage, it is required to provide both the operational amplifier for N-channel MOS input and the operational amplifier for P-channel MOS input. In the above structure, however, the positive polarity D/A conversion circuits DA1, DA3 output only voltages of not less than around a half of the power supply voltage Vcc, and only the circuit for the N-channel input will be sufficient as the operational amplifier. Similarly, the negative polarity D/A conversion circuits DA2, DA4, . . . output only a voltage of not more than around a half of the power supply voltage Vcc, only the circuit for the P-channel input will be sufficient as an operational amplifier. Therefore, D/A conversion circuits DA1 and DA2, and operational amplifiers OP1 and OP2 are used in common between each pair of adjacent two data signal lines of the odd-numbered data signal lines D1, D3, . . . , and the even-numbered data signal lines D2, D4, . . .

Namely, the data driver DD as the data signal line driving circuit of the present invention is arranged so as to include:

the positive polarity D/A converter and the operational amplifier of the N-channel MOS transistor input as a positive voltage output section for outputting a positive voltage converted from a data signal;

the negative polarity D/A converter and the operational amplifier of the P-channel MOS transistor as a negative voltage output section for outputting a negative voltage converted from a data signal; and a switching section for switching the positive output section and the negative output section between adjacent data signal lines, wherein the positive voltage output section and the negative voltage output section are used in common in the adjacent data signal lines.

As a result, it is possible to reduce the required structure to about the half as that required in the case of adopting the D/A conversion circuits and operational amplifiers in both positive and negative polarities for each data signal line D, thereby realizing reduction in chip-size and the power consumption.

Gradation display voltages from the switches Sb1, Sb2, . . . , conduct/cut off in response to a switch control signal from the control circuit 15, and are then output to the data signal line D via the separation switches S1, S2, . . . (hereinafter referred to as a general symbol S) (separation means) corresponding to the output circuit 28. This separation switch S is composed of an analog switch such as a MOS transistor, a transmission gate, etc.

On the other hand, the liquid crystal panel 12 includes a plurality of scanning signal lines G1, G2, . . . and data signal lines D1, D2, . . . which cross each other, and further includes in each area surrounded by adjacent two scanning signal lines and the data signal lines, an elctro-optical element and a switching element TFT11, TFT12, . . . (hereinafter) simply referred to as TFT when it is not necessarily be specified) and pixel capacitor C11, C12, . . . , which correspond to the electro-optical element. The liquid crystal panel 12 is of the active matrix type wherein liquid crystal elements as electro-optical elements are driven/displayed by charges as input in the pixel capacitors C11, C12, . . . , by the switching elements TFT11, TFT12, . . . In FIGS. 6 to 10, the liquid crystal capacitors and the auxiliary capacitors together are referred to as the pixel capacitors C11, C12, . . .

Figure 6:
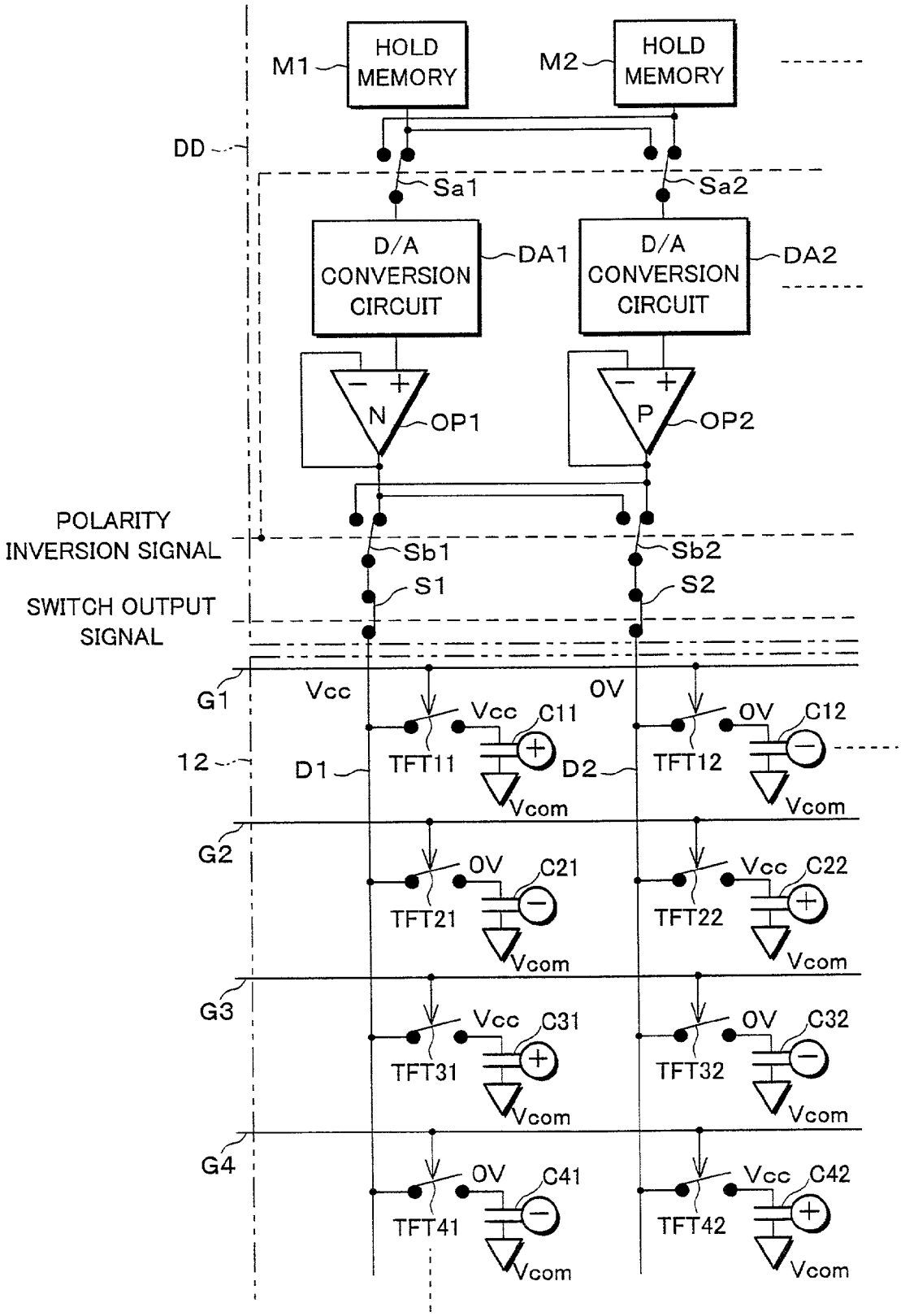
FIG. 6 is an explanatory view of operations of the present invention.

In the foregoing liquid crystal panel 12, for simplification of the explanations, the potential of the counter electrode is fixed at a predetermined voltage Vcom, when display-driving the liquid crystal, the gradation display voltage is set to Vcc (positive polarity potential) or 0V (negative polarity potential), and in-non display driving, the gradation display voltage is set to the potential Vcom of the counter electrode, i.e., Vcc/2. In the example of FIG. 6, all the pixels are set active to perform a display. For example, in the direction of the scanning signal line G1, the pixel corresponding to the TFT 11 displays in positive potential, and the pixel corresponding to the TFT 12 is displayed in negative potential, which indicates that the dot-inverse driving method is performed. On the other hand, in the direction of the data signal line D1, the pixels in the TFTs 11 and 13 display in positive polarity potential, and pixels in TFT 21, TFT 41 perform display in negative potential, which indicates that the line inverse driving method is performed.

Furthermore, the separation switches S1 and S2 conduct, and the positive voltage Vcc is output to the data signal line D1 corresponding to the D/A conversion circuit DA1 and the operational amplifier OP1. On the other hand, a negative voltage 0V is output to the data signal line D2 corresponding to the D/A conversion circuit DA2 and the operational amplifier OP2 All the TFTs 11 to 14 shown in FIG. 6 are cut off, and the separation switches s1 and s2 conduct as explained earlier, and thus in the structure of FIG. 6, the display data are input in the line to be scanned later than the scanning signal line G5 (not shown).

Figure 11:
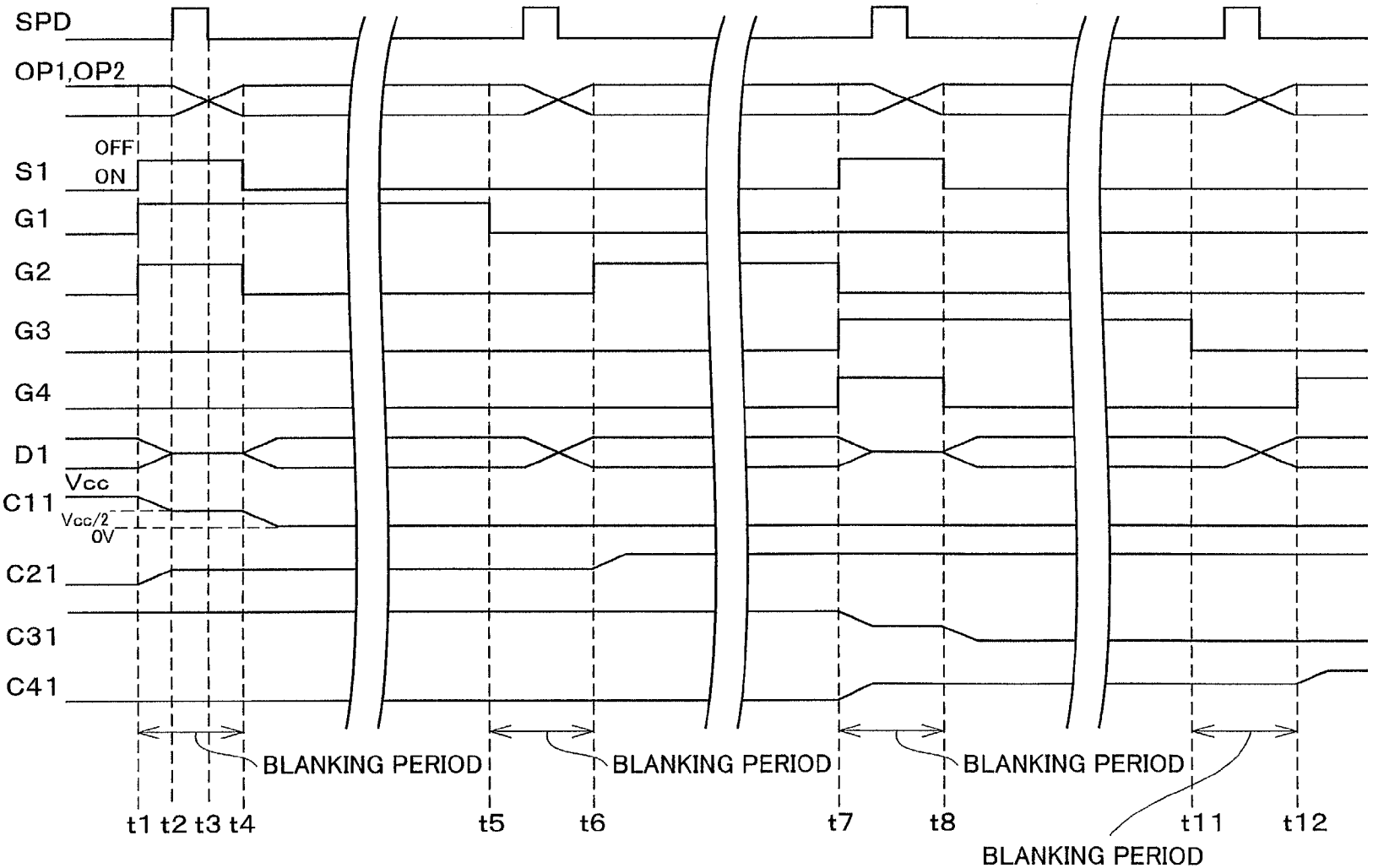
FIG. 11 is a timing chart which explains operations shown in FIG. 6 to FIG. 10.
Figures 12, 13A, 13B:
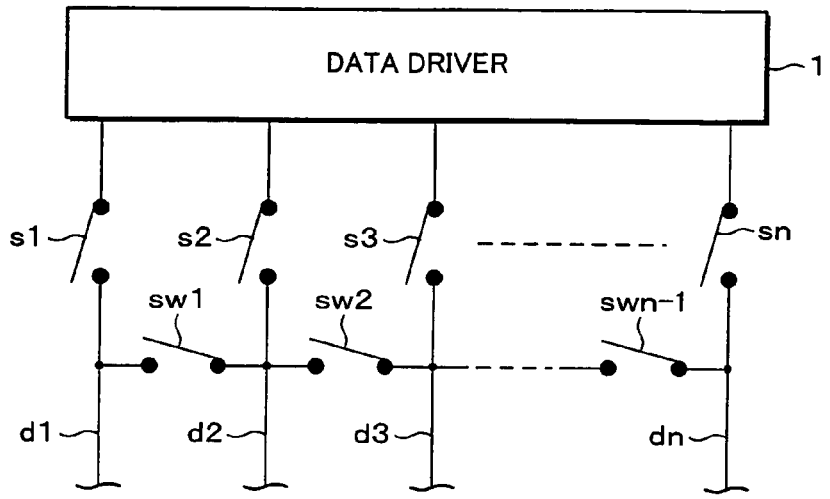
FIG.12 PRIOR ART
FIG.13(a) PRIOR ART
FIG.13(b) PRIOR ART
FIG. 12 is a block diagram illustrating a schematic structure of a typical conventional structure.

FIG. 11 is a timing chart which explains operations of the liquid crystal display device 11 having the foregoing structure. FIG. 11 shows the waveform for one line of the data signal line D1. Subsequent to the vertical synchronization signal CLD (not shown in FIG. 11), the first line is set in the scanning period, and in the first half of the scanning period, the blanking period is set over the periods t1 to t4 including the periods t2 and t3 of the horizontal synchronization signal SPD.

As illustrated in FIG. 11, the image display device of the present invention is arranged so as to control to cut off the separation switch S as the separation means in a blanking period at every two horizontal scanning periods (blanking period provided directly before the selection-scanning period of the scanning signal line to be scanned first of the pair), and to perform the selection-scanning operation of the target pair of scanning signal lines in the cut-off state of the separation means.

In FIG. 11, the waveform corresponding to S1 is of a separation signal which controls the separation switch, and when this separation signal is in the high level, the separation switch conducts, and in the low level, the separation switch is cut off.

Figure 7:
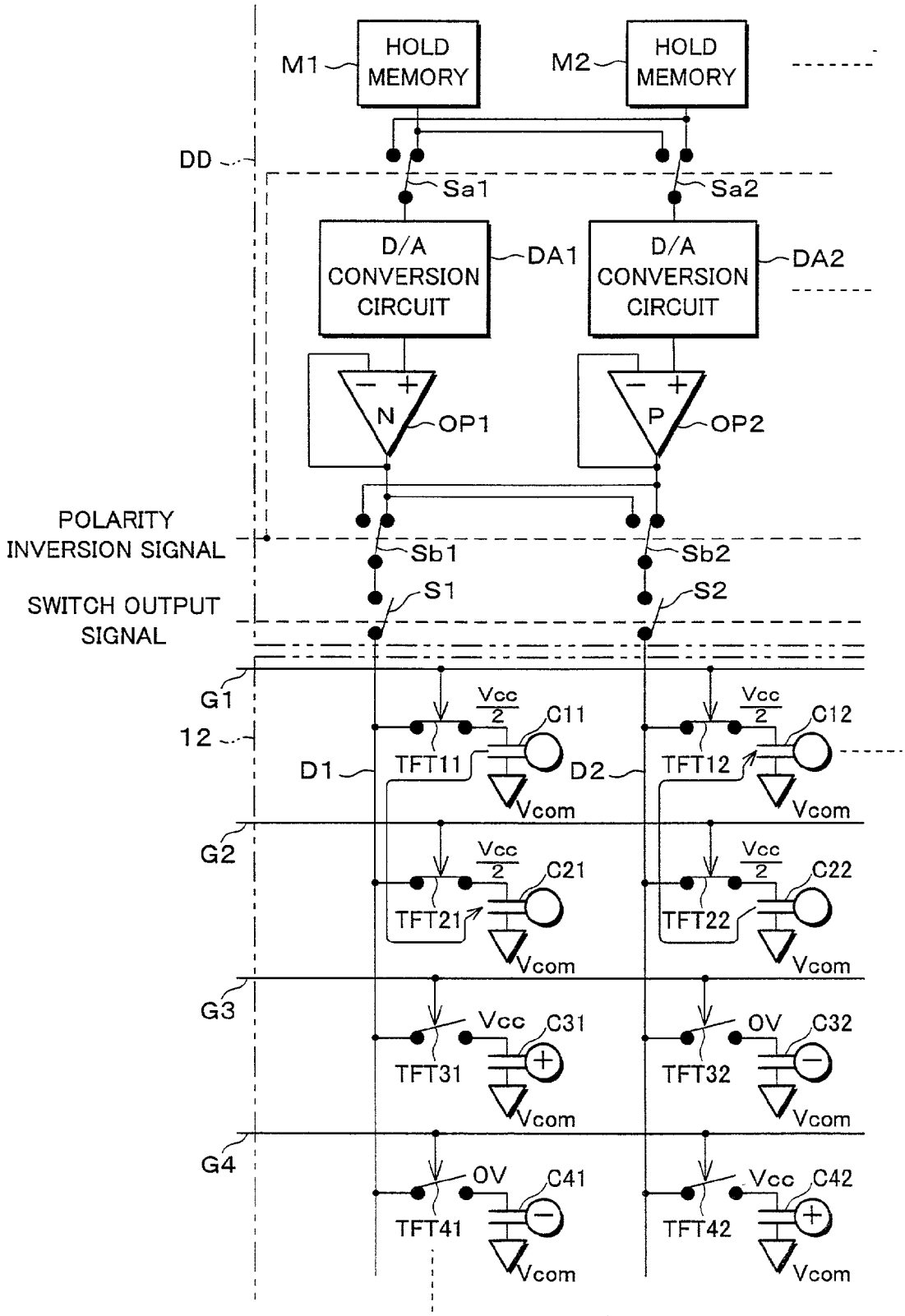
FIG. 7 is an explanatory view of operations of the present invention.

In this blanking period, as illustrated in FIG. 7, the separation switch S1 is cut off, and the scanning signal lines G1 and G2 which make a pair are set to a high level, and the TFTs 11 and 21 conduct. As a result, the pixel capacitors C11, C21 are short-circuited via the data signal line D1, and the charge in the high level Vcc of the pixel capacitor C11 and the charge in the low level 0V of the pixel capacitor C21 are neutralized. Therefore, in the case where the capacitance of the pixel capacitor C21 is equivalent to the capacitance of the pixel capacitor C21, the pixel capacitor is set to the potential Vcom of the counter electrode, i.e., Vcc/2. Here, if the pixel capacitor C21 is in the non-display state (Vcc/2), after being neutralized, the potential is set to 3Vcc/4, and when the pixel capacitor C11 is in the non-display state, the potential after being neutralized is set to Vcc/4.

Figure 8:
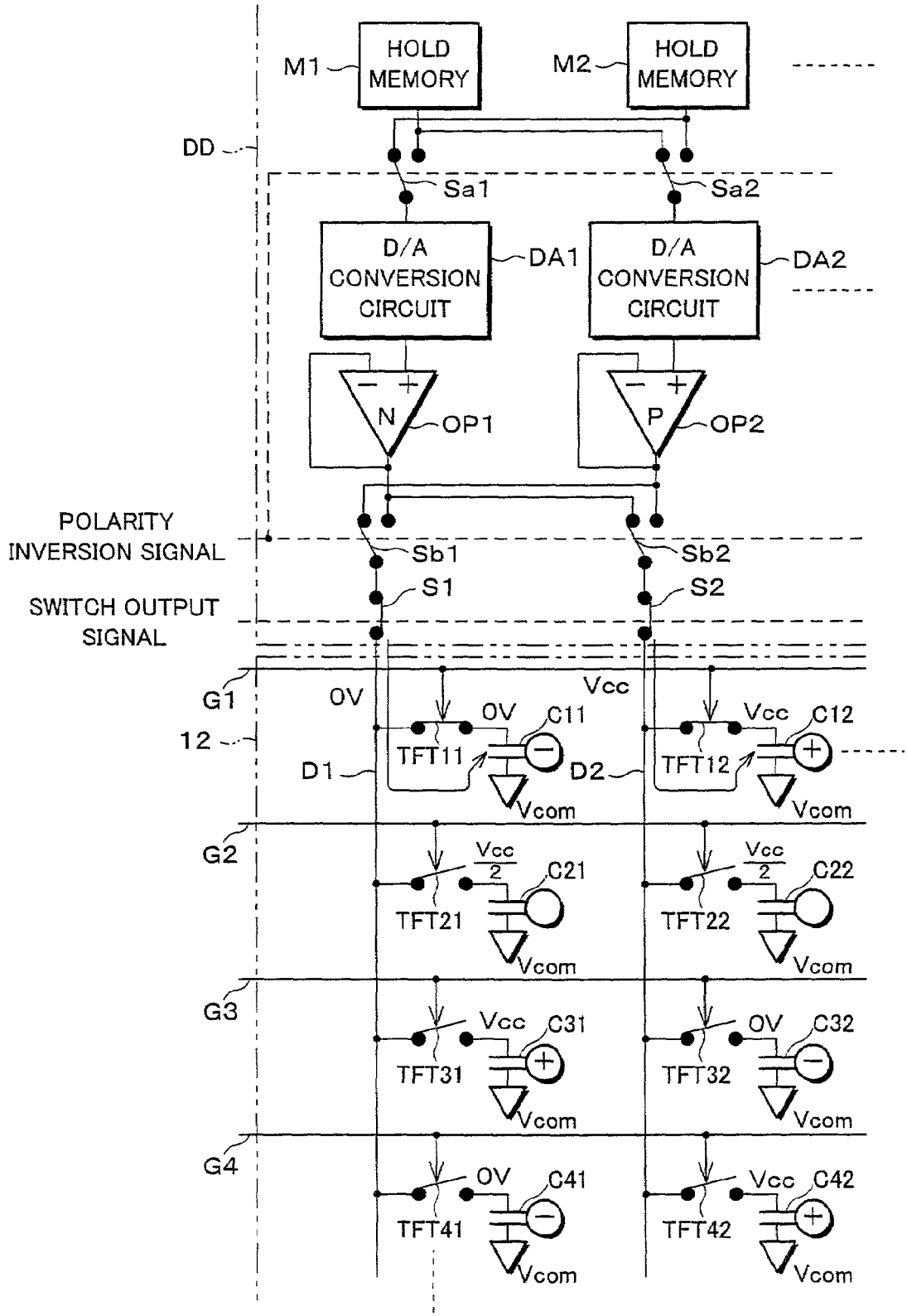
FIG. 8 is an explanatory view of operations of the present invention.

After the blanking period ends at t4, the scanning signal line G1 is maintained at high level, while the scanning signal line G2 is switched to the low level, and as illustrated in FIG. 8, the TFT 21 is cut-off, and the separation switch S1 conducts. As a result, to the pixel capacitor C11, display data of new frame at low level 0V is input via the data signal line D1, thereby starting a display operation.

Figure 9:
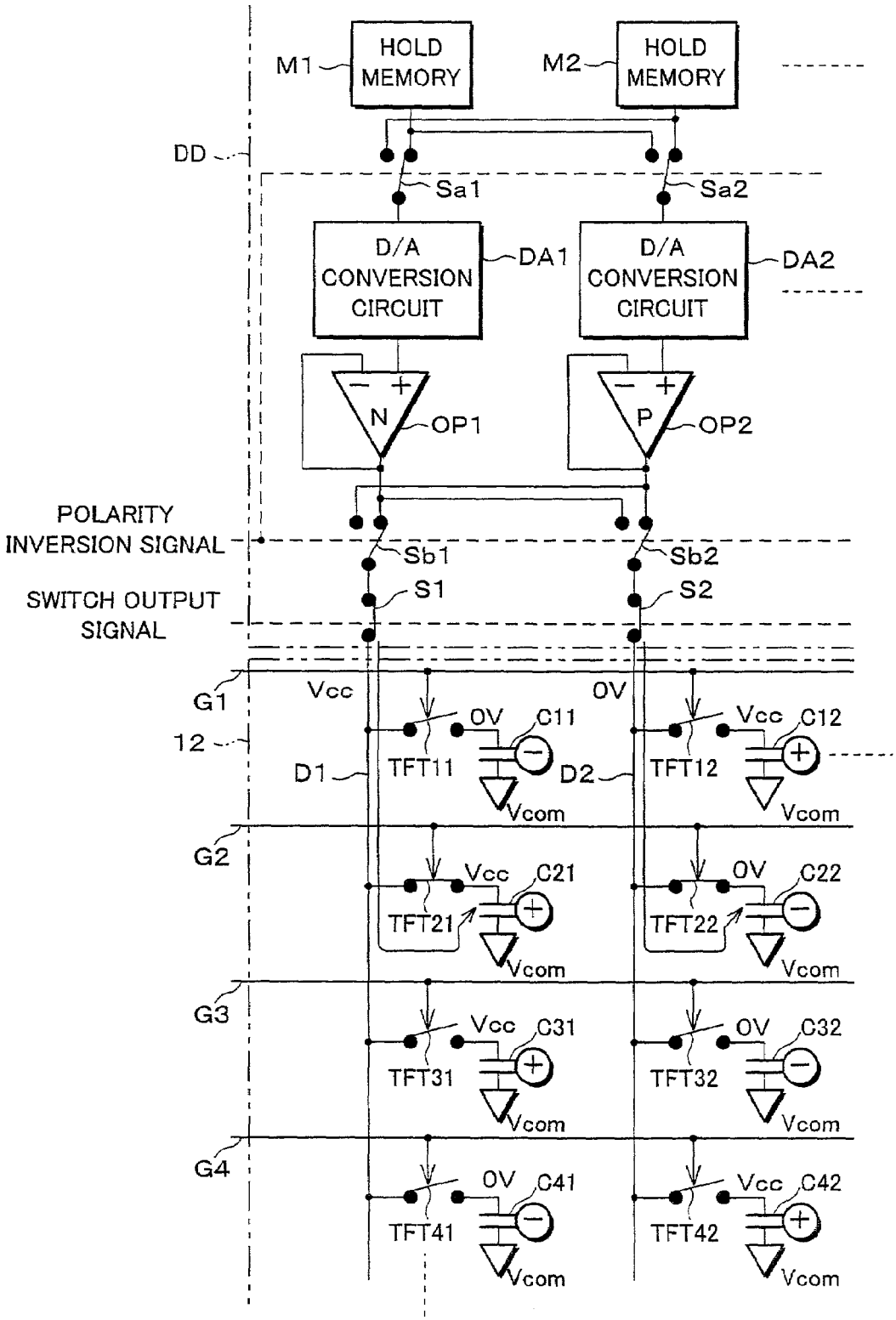
FIG. 9 is an explanatory view of operations of the present invention.

When the scanning period for the second line starts at t5, the scanning signal line G1 is also set to the low level, and the TFT 111 is cut-off. Then, the blanking period ends at t6 at which the scanning signal line G2 is set to the high level, and the TFT 21 conducts as illustrated in FIG. 9. Here, the separation switch s1 is kept conducted from t4. As a result, via the data signal line D1, the display data of new frame at high level Vcc is input into the pixel capacitor C21, thereby starting a display operation.

Figure 10:
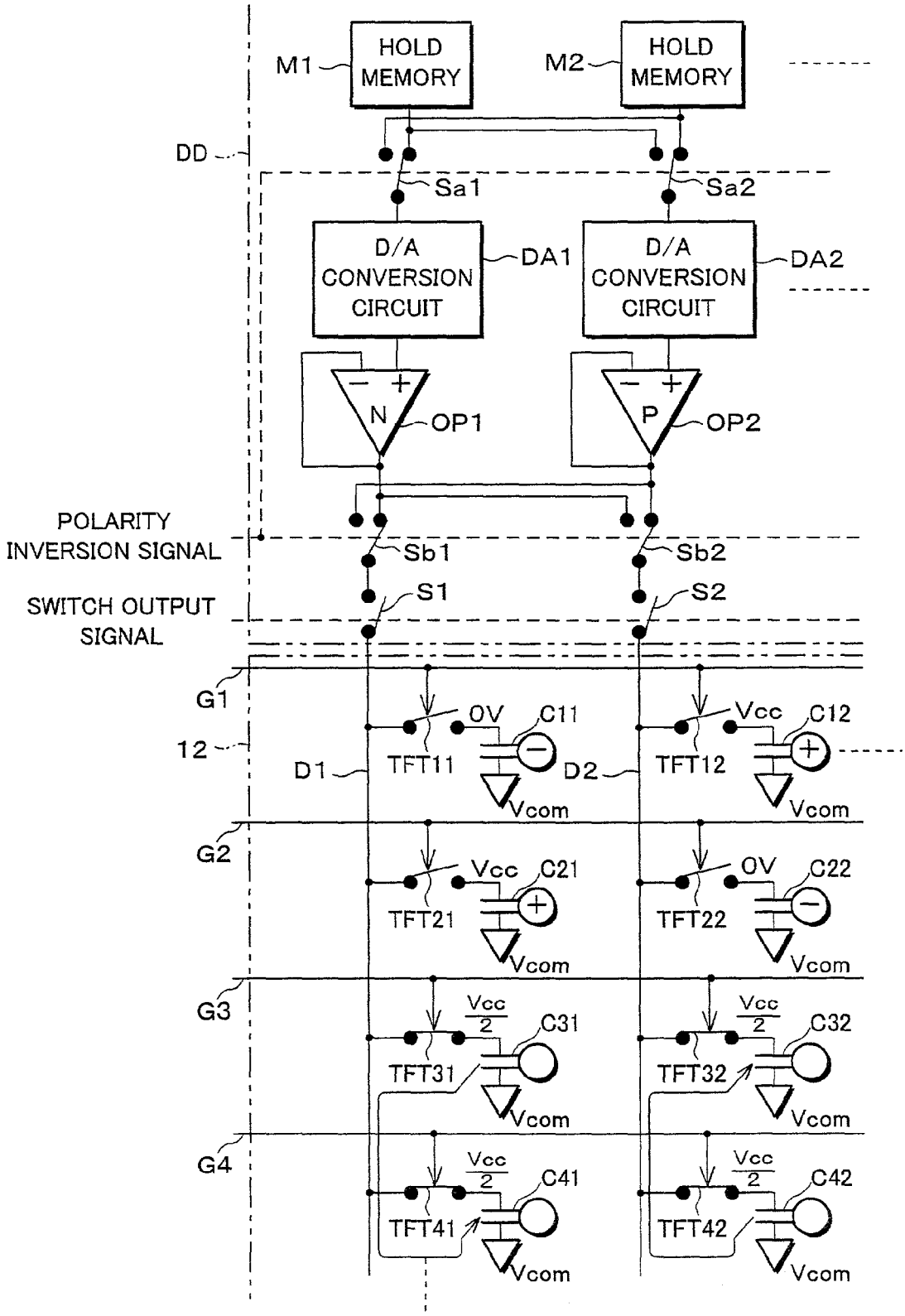
FIG. 10 is an explanatory view of operations of the present invention.

Then, as illustrated in FIG. 10, when the scanning period for the third line starts at t7, the TFT 21 is cut-off. Then, as in the period of t1 to t4, in the first half of the blanking period, the separation switch s1 is cut-off, and the pair of the scanning signal lines G3 and G4 is set to the high level, and TFTs 31 and 41 conduct. As a result, the pixel capacitors C31 and C41 are short-circuited via the data signal line D1, and charges in the high level Vcc of the pixel capacitor C31 and a charge at low level 0V of the pixel capacitor C41 shown in FIG. 6 are neutralized, and when respective capacitances of the pixel capacitors C31 and C41 are equivalent, the potential of these pixel capacitors C31 and C41 is set to a potential Vcom of the counter electrode, Vcc/2.

Then, as in the case at and after the time t4, the separation switch S1 conducts, and via the TFT 31, the display data in new frame at low level 0V is input in the pixel capacitor C31 via the TFT 31, and display is started. Then, via the TFT 41, the display data in new frame at high level Vcc is input in the pixel capacitor C41 via the TFT 41, and display is started.

As described, the liquid crystal display device 11 of the present invention is arranged such that after the scanning period for the scanning signal line G ends, and a horizontal synchronization signal for use in scanning the next scanning signal line G enters, and further the next display data has been transferred in the shift register 22 in the data driver DD, in the blanking period till the voltage for gradation display is stabilized in the output circuit 28, adjacent pixel capacitors C11, C12; C31, C32; . . . , and C21, C22; C41, C42, . . . are short-circuited via data signal lines D utilizing the feature that respective pixels in adjacent lines are of reverse polarities in the line inverse driving method, thereby moving charges. This shift in charges does not consume power in the liquid crystal display device, and it is therefore possible to reduce an amount of charges required for the data driver DD to charge the data signal line D, thereby reducing an amount of power consumption, and suppressing the dulling of the waveform.

The foregoing structure is therefore suited for a large-size screen. Further, since charges are neutralized using TFTs and the data signal line D for respective pixels, for example, by adopting the structure shown in FIG. 3 of the gate driver DG, and altering the selection scanning, the structure can be simplified without requiring switches dedicated for use in short-circuiting.

The present invention is also applicable to the dot inverse driving method, and in this case, a switch is provided as short-circuit means between adjacent pixels of mutually reverse polarities, and this switch can be functioned by conducting/driving signal lines provided in common between adjacent pixels in parallel to the scanning signal line directly before scanning the scanning signal line G. According to the foregoing structure, the switch and the signal line are required on the side of the liquid crystal panel, the short circuiting is performed in the state where the scanning signal line G is not subjected to the scanning, i.e., in the state where the TFT is cut-off, and each of the pixel capacitors C11, C12, . . . is separated from the data signal line D. It is therefore possible to adopt the conventional data driver for the DATA driver DD without the seperation switch 29.

As described, according to the image display device of the active-matrix type of the present invention, when AC driving, the line inverse driving method wherein voltages for gradation display in reverse polarities are output with respect to pixels adjacent in the data signal line direction, and/or the dot inverse driving method wherein voltages for gradation display in reverse polarities are output with respect to pixels adjacent in the scanning signal line direction is/are adopted in order to switch the polarities of the voltages for gradation display at every one or every plurality of frames. Then, in the selection-scanning period of the previous scanning signal line, i.e., in the non-selection period directly before the selection-scanning period of the target scanning signal line, the short circuit means short circuits the pair of pixel capacitors to sufficiently neutralize the respective charges before inputting a data signal by selection-scanning the target scanning signal line.

It is therefore possible to reduce an amount of charges required for the data signal line driving circuit to charge the data signal line, which leads to a reduction in power consumption. Further, the neutralization of charges is performed between adjacent pixels, and thus the short-circuit means can be provided on the display panel. It is therefore possible to realize the data signal line driving circuit of simplified structure, and to suppress the problem of dull waveform. Furthermore, the short-circuited pixels are in the non-selection state, and are separated from the data signal line, and the effects on the data signal line driving circuit can therefore be avoided, thereby realizing the structure suited for a large-size screen.

As described, according to the image display device of the active-matrix type of the present invention, the AC driving is performed by the line inverse driving method, and the polarities for voltages for gradation display are switched at every or every plurality of frames with respect to a pair of pixels adjacent in the data signal line direction. Further, in the blanking period before a selection-scanning period of the scanning signal line to be scanned first in each pair, the data signal line is separated from the data signal line driving circuit by the separation means, and then the scanning signal line to be scanned next of the pair is also subjected to selection scanning, thereby neutralizing charges of the adjacent pixel capacitors via the data signal line.

Therefore, it is possible to reduce an amount of charges required for the data signal line driving circuit to charge the data signal line, thereby realizing reduction in power consumption and suppressing the problem of dull waveform. As a result, the present invention is suited for a large-size screen. Furthermore, the foregoing neutralization of charges is performed by using the switching element for each pixel and the data signal line. Namely, according to the present invention, it is possible to neutralize the charges only with a simple structure by merely modifying the selection scanning of the scanning signal line driving circuit without requiring switches for short-circuiting.

As described, an image display device of the present invention which includes in each pixel region surrounded by adjacent two of a plurality of scanning signal lines and adjacent two of a plurality of data signal lines which cross each other, an electro-optical element, and a switching element and a pixel capacitor which correspond to the electro-optical element, and which performs a display-driving of the electro-optical element by a charge as input in the pixel capacitor by the switching element, is characterized in that:

a data signal line driving circuit outputs voltages for gradation display in mutually reverse polarities with respect to a pair of adjacent pixels, and the image display means further includes:

short-circuit means for short-circuiting a pair of pixel capacitors of the pair of adjacent pixels in a selection-scanning period of a previous scanning signal line when scanning by switching polarities of the voltages for gradation display.

According to the foregoing structure of the image display device of the active-matrix type, the switching element is provided at each intersection between adjacent scanning signal lines and adjacent data signal lines which cross each other, and the switching element inputs a voltage for gradation display for a data signal line into a pixel capacitor by selection-scanning a scanning signal line, and the electro-optical element is display-driven by the charge as input by the switching element, thereby maintaining a display state also in a non-selection period. Namely, when AC driving, the line inverse driving method wherein voltages for gradation display in reverse polarities are output with respect to adjacent pixels in the data signal line direction, and/or the dot inverse driving method wherein voltages for gradation display in reverse polarities are output with respect to adjacent pixels in the scanning signal line direction are/is adopted. The frame inverse driving method wherein voltages for gradation display in reverse polarities are output with respect to adjacent frames may also be adopted in the above AC driving.

Further, when switching polarities of voltages for gradation display at every one or every plurality of frames, the short-circuit means short-circuits the pair of pixel capacitors in the selection scanning period of the previous scanning signal line, i.e., in the non-selection period directly before selection-scanning the target scanning signal line.

Therefore, when switching polarities of voltages for gradation display, after neutralizing respective charges in pixel capacitors of adjacent pixels in reverse polarities, the target scanning signal lines are subjected to selection-scanning, and then the data signal is input. As a result, it is possible to reduce an amount of charges required for the data signal line driving circuit to charge the data signal line, and power consumption. Further, the neutralization of charges is performed between adjacent pixels, and thus the short-circuit means is provided on the display panel. It is therefore possible to realize the data signal line driving circuit of simplified structure, and to suppress the problem of dull waveform. Furthermore, the pixels are short-circuited in the non-selection period, and the pixels are separated from the data signal lines, and adverse effects on the data signal line driving circuit can be therby avoided.

Another image display device of the present invention which includes in each pixel region surrounded by adjacent two of a plurality of scanning signal lines and adjacent two of a plurality of data signal lines which cross each other, an electro-optical element, and a switching element and a pixel capacitor which correspond to the electro-optical element, and which performs a display-driving of the electro-optical element by a charge as input in the pixel capacitor by the switching element, is characterized by including:

separation means for separating an output stage of the data signal line driving circuit from a data signal line in a first half of a selection-scanning period of each scanning signal line by a scanning signal line driving circuit, the separation means being provided between the output stage of the data signal line driving circuit and the data signal line, wherein the data signal line driving circuit outputs voltages for gradation display in mutually reverse polarities with respect to adjacent pixels in a direction of the data signal line; and the scanning signal line driving circuit carries out a selection-scanning operation by switching polarities of voltages for gradation display, with respect to both a data signal line to be scanned first and a data signal line to be scanned next in a pair, in a first half of the selection-scanning period of the scanning signal line to be scanned first in the pair.

A still another display device of the present invention which includes in each pixel region surrounded by adjacent two of a plurality of scanning signal lines and adjacent two of a plurality of data signal lines which cross each other, an electro-optical element, and a switching element and a pixel capacitor which correspond to the electro-optical element, and which performs a display-driving of the electro-optical element by a charge as input in the pixel capacitor by the switching element, is characterized by including:

separation means for separating an output stage of the data signal line driving circuit from the data signal line in a blanking period directly before a selection-scanning period of each scanning signal line by a scanning signal line driving circuit, the separation means being provided between the output stage of the data signal line driving circuit and the data signal line, wherein the data signal line driving circuit outputs voltages for gradation display in mutually reverse polarities with respect to adjacent pixels in a direction of the data signal line; and the scanning signal line driving circuit carries out a selection-scanning operation by switching polarities of voltages for gradation display, with respect to both a data signal line to be scanned first and a data signal line to be scanned next, in the blanking period directly before the selection-scanning period of the scanning signal line to be scanned first of the pair.

According to the foregoing structure of the image display device of the active-matrix type, the switching element is provided at each intersection between adjacent scanning signal lines and adjacent data signal lines which cross each other, and the switching element inputs a voltage for gradation display for a data signal line into a pixel capacitor by selection-scanning a scanning signal line, and the electro-optical element is display-driven by the charge as input by the switching element, thereby maintaining a display state also in a non-selection period. Namely, when AC driving, the line inverse driving method is adopted. In this AC driving, the dot inverse driving method and/or the frame inverse driving method wherein voltages for gradation display in mutually reverse polarities are output with respect to adjacent frames may be combined with the foregoing line inverse driving method.

When switching polarities of voltages for gradation display at every frame or every plurality of frames, the scanning signal line driving circuit carries out a selection-scanning operation by switching polarities of voltages for gradation display with respect to both of the data signal line to be scanned first and the data signal line to be scanned next in the pair, in the blanking period directly before the selection-scanning period of the scanning signal line to be scanned first of the pair. Here, the data signal line is separated from the data signal line driving circuit by the separation means.

Therefore, in the adjacent pixels of the pair, by carrying out selection/scanning of the scanning signal lines simultaneously in the blanking period directly before the selection-scanning period of the scanning signal line to be scanned first, only this scanning signal line is subjected to selection scanning after neutralizing the charges of the pixel capacitors via the data signal line, and the data signal line is input into the capacitor from the data signal line driving circuit. Then, in the blanking period directly before the selection-scanning period of the scanning signal line to be scanned next, both of the scanning signal lines in the pair are set in the non-selection state, and then only the scanning signal line to be scanned next is subjected to the selection scanning, and the data signal is input into the pixel capacitor from the data signal line driving circuit.

Therefore, when switching polarities of voltages for gradation display, charges in pixel capacitors between adjacent pixels in mutually reverse polarities can be sufficiently neutralized. It is therefore Possible to reduce an amount of charges required for the data signal line driving circuit to charge the data signal line, thereby realizing a reduction in power consumption and suppressing the problem of dull waveform. As a result, the present invention is suited for a large-size screen. Furthermore, the foregoing neutralization of charges is performed by using the switching element for each pixel and the data signal line. Namely, according to the present invention, it is possible to neutralize the charges only by modifying the selection scanning of the scanning signal line driving circuit without requiring switches for short-circuiting.

The concrete emobodiments and implementation examples discussed in the foregoing detailed explanation of the present invention serve solely to illustrate the technical details of the invention, which should not be narrowly interpreted within the limits of such concrete examples, but rather may be applied in many variations without departing from the spirit of this invention and the scope of the patent claims set forth below.

What is claimed is:

1. An image display device, comprising:

a plurality of scanning signal lines and a plurality of data signal lines which cross each other;

an electro-optical element, and a switching element and a pixel capacitor which correspond to said electro-optical element, said electro-optical element and corresponding switching element and pixel capacitor being provided in each pixel region surrounded by adjacent two of said plurality of scanning signal lines and adjacent two of said plurality of data signal lines;

a data signal line driving circuit for outputting voltages for display in mutually reverse polarities with respect to a pair of adjacent pixels in a direction of the data signal lines; and short-circuit means for short-circuiting respective pixel capacitors of said pair of adjacent pixels before applying the voltages for display to a pixel to be scanned first of the pair of adjacent pixels in the direction of the data signal lines when scanning in switching polarities of the voltages for display;

wherein said short-circuit means carries out selection scanning of respective scanning signal lines of the pair of adjacent pixels in the direction of the data signal lines at the same time to drive the switching elements of the pair of the pixels at the same time.

2. The image display device as set forth in claim 1, wherein:

said data signal line driving circuit outputs voltages for gradation display in mutually reverse polarities with respect to a pair of pixels adjacent in a direction of said scanning signal lines.

3. The image display device as set forth in claim 1, wherein:

said data signal line driving circuit outputs voltages for gradation display in mutually reverse polarities with respect to a pair of pixels adjacent in a direction of said data signal lines.

4. The image display device as set forth in claim 1, wherein said data signal line driving circuit includes:

a positive voltage output section for outputting a positive voltage converted from a data signal;

a negative voltage output section for outputting a negative voltage converted from a data signal; and a switching section for switching said positive output section and said negative output section between adjacent data signal lines, wherein said positive voltage output section and said negative voltage output section are used in common in said adjacent data signal lines.

5. The image display device as set forth in claim 4, wherein:

said positive voltage output section includes a positive polarity D/A converter and an operational amplifier of an N-channel MOS transistor input; and said negative voltage output section includes a negative polarity D/A converter and an operational amplifier of a P-channel MOS transistor input.

6. The image display device as set forth in claim 1, wherein:

said data signal line driving circuit outputs voltages for gradation display in mutually reverse polarities with respect to adjacent frames.

7. An image display device, comprising:

a plurality of scanning signal lines and a plurality of data signal lines which cross each other;

an electro-optical element, and a switching element and a pixel capacitor which correspond to said electro-optical element, said electro-optical element and corresponding switching element and pixel capacitor being provided in each pixel region surrounded by adjacent two of said plurality of scanning signal lines and adjacent two of said data signal lines;

a data signal line driving circuit for outputting voltages for gradation display in mutually reverse polarities with respect to a pair of adjacent pixels; and separation means for separating an output stage of said data signal line driving circuit from a data signal line in a first half of a selection-scanning period of each scanning signal line by a scanning signal line driving circuit, said separation means being provided between said output stage of said data signal line driving circuit and said data signal line, wherein said data signal line driving circuit outputs voltages for gradation display in mutually reverse polarities with respect to adjacent pixels in a direction of said data signal line; and said scanning signal line driving circuit carries out a selection-scanning operation by switching polarities of voltages for gradation display, with respect to both of a scanning signal line to be scanned first and a scanning signal line to be scanned next of a pair, in a first half of the selection-scanning period of the scanning signal line to be scanned first of the pair and wherein said scanning signal line driving circuit carries out selection scanning of respective scanning signal lines of the pair of adjacent pixels in the direction of the data signal lines at the same time to drive the switching elements of the pair of pixels at the same time.

8. An image display device, comprising:

a plurality of scanning signal lines and a plurality of data signal lines which cross each other;

an electro-optical element, and a switching element and a pixel capacitor which correspond to said electro-optical element, said electro-optical element and corresponding switching element and pixel capacitor being provided in each pixel region surrounded by adjacent two of said plurality of scanning signal lines and adjacent two of said data signal lines;

a data signal line driving circuit for outputting voltages for gradation display in mutually reverse polarities with respect to a pair of adjacent pixels; and separation means for separating an output stage of said data signal line driving circuit from said data signal line in a blanking period directly before a selection-scanning period of each scanning signal line by a scanning signal line driving circuit, said separation means being provided between said output stage of said data signal line driving circuit and said data signal line, wherein said data signal line driving circuit outputs voltages for gradation display in mutually reverse polarities with respect to adjacent pixels in a direction of said data signal line; and said scanning signal line driving circuit carries out a selection-scanning operation by switching polarities of voltages for gradation display, with respect to both of a scanning signal line to be scanned first and a scanning signal line to be scanned next in a pair, in the blanking period directly before the selection-scanning period of the scanning signal line to be scanned first of the pair and wherein said scanning signal line driving circuit carries out selection scanning of respective scanning signal lines of the pair of adjacent pixels in the direction of the data signal lines at the same time to drive the switching elements of the pair of pixels at the same time.

9. The image display device as set forth in claim 8, further comprising:

control means for controlling to cut off said separation means in a blanking period at every two horizontal scanning periods, said blanking period being provided directly before the selection-scanning period of the scanning signal line to be scanned first of the pair, and to perform the selection-scanning operation of the target pair of scanning signal lines in the cut-off state of said separation means.

10. An image display device, comprising:

a plurality of scanning signal lines and a plurality of data signal lines which cross each other;

an electro-optical element, and a switching element and a pixel capacitor which corresponds to said electro-optical element, said elctro-optical element and corresponding switching element and pixel capacitor being provided in each pixel region surrounded by adjacent two of said plurality of scanning signal lines and adjacent two of said plurality of data signal lines; and a data signal line driving circuit for outputting voltages for display in mutually reverse polarities with respect to a pair of adjacent pixels in a direction of data signal lines, a scanning signal line driving circuit carries out selection scanning with respect to a scanning signal line of a pixel to be scanned first and a scanning signal line of a pixel to be scanned next of said pair of adjacent pixels in the direction of data signal lines at the same time, to drive the switching elements of said pair of adjacent pixels at the same time, before applying the voltages for display to the pixel to be scanned first of said pair of adjacent pixels when scanning in switching polarities of the voltages for display.

11. An image display device, comprising:

a plurality of scanning signal lines and a plurality of data signal lines which cross each other;

an electro-optical element, and a switching element and a pixel capacitor which corresponds to said electro-optical element, said elctro-optical element and corresponding switching element and pixel capacitor being provided in each pixel region surrounded by adjacent two of said plurality of scanning signal lines and adjacent two of said plurality of data signal lines; and a data signal line driving circuit for outputting voltages for display in mutually reverse polarities with respect to a pair of adjacent pixels in a direction of data signal lines, and separation means provided between an output stage of the data signal line driving circuit and the data signal line, for electrically separating the output stage from the data signal line, wherein a scanning signal line driving circuit carries out selection scanning with respect to a scanning signal line of a pixel to be scanned first together with a scanning signal line of a pixel to be scanned next of said pair of adjacent pixels in the direction of data signal lines before applying the voltages for display to the pixel to be scanned first of said pair of adjacent pixels when scanning in switching polarities of the voltages for display; and wherein when said scanning signal line driving circuit carries out selection scanning with respect to the scanning signal line of the pixel to be scanned first together with scanning signal line of the pixel to be scanned next, said separation means electrically separates the output stage of the data signal line driving circuit from the data signal line.

* * * * *